United States Patent [19]

Tucci

[11] 3,987,531

[45] Oct. 26, 1976

[54] FIXTURE AND JIG FOR USE IN CONNECTING WIRES TO CONNECTORS

[75] Inventor: John James Tucci, Winston-Salem, N.C.

[73] Assignee: AMP Incorporated, Harrisburg, Pa.

[22] Filed: Jan. 14, 1976

[21] Appl. No.: 649,008

[52] U.S. Cl. ..... 29/203 MW; 29/203 P

[51] Int. Cl.[2] ..... H01R 43/00

[58] Field of Search ..... 29/203 J, 203 MW, 203 P

[56] References Cited

UNITED STATES PATENTS

| | | | |
|---|---|---|---|
| 3,800,390 | 4/1974 | Johnston | 29/203 P |
| 3,816,897 | 6/1974 | Long | 29/203 MW |
| 3,866,296 | 2/1975 | Tucci | 29/203 MW |
| 3,872,567 | 3/1975 | Cea et al. | 29/203 MW |

*Primary Examiner*—Robert Louis Spruill
*Attorney, Agent, or Firm*—F. W. Raring; R. W. Pitts; Jay L. Seitchik

[57] ABSTRACT

Fixture for use in locating wires in wire-receiving jigs comprises a fixture block having an upper surface upon which locating bosses are provided for locating two wire jigs in parallel spaced-apart relationship. A slot extends into one end of the block and has an inner end which is between the locating bosses. A cable containing a plurality of wires is positioned in the slot with the cable axis extending normally of the upper surface. The wire jigs are positioned on the bosses and the wires can thereafter be positioned in the wire jigs. The cable can be located at different relative positions in the slot for different wiring configurations in the connector to which the wires are later attached.

8 Claims, 10 Drawing Figures

FIXTURE AND JIG FOR USE IN CONNECTING WIRES TO CONNECTORS

BACKGROUND OF THE INVENTION

This invention relates to fixtures which are used in conjunction with wire jigs which in turn are used in a process of trimming a plurality of wires and connecting the trimmed wires to terminals in a multi-contact electrical connector. Wiring jigs and fixtures in accordance with the present invention, are disclosed and claimed in U.S. Pat. No. 3.800,390.

The above identified U.S. Pat. No. 3,800,390 discloses a wire inserting tool which trims the ends of a plurality of wires and substantially simultaneously inserts the trimmed ends into terminals in a two-row electrical connector. The wires are located in the tool by means of two wire jigs which hold the wires in side by side parallel relationship. In accordance with the teachings of U.S. Pat. No. 3,800,390, the wires are initially positioned in the jigs by mounting the jigs on a fixture to which the cable is clamped and thereafter positioning the individual wires in the wire jigs. Subsequently, the wire jigs and the cable are removed from the fixture, the wire jugs are mounted on the tool, and the tool is then operated to trim the wires and connect them to terminals in a connector which is also held on the tool.

The wiring fixture disclosed in U.S. Pat. No. 3,800,390 has been, and is being, widely used, however, this fixture is capable of positioning the wires such that only one wiring configuration can be provided in the connector.

It should be explained at this point, that when a plurality of wires are connected to terminals in a two-row connector, the wires will be in either one of two possible wiring configurations. In one configuration, the axis of the cable extends centrally towards the rearward side of the connector and, adjacent to the rearward side, the wires diverge and extend to the individual terminals to which they are connected, In the other wiring configuration, the axis of the cable extends parallel to the rearward side of the connector and the individual wires extend laterally from the cable axis to the individual terminals to which they are connected.

The fixture disclosed in U.S. Pat. No. 3,800,390 is useful only to connect wires to a connector in the second configuration described above and the instant invention is directed to the achievement of a fixture which can be used to connect wires in either of the two configurations. The invention is further directed to the achievement of a fixture which can be used to position the individual wires in a ribbon cable in wire jigs to facilitate subsequent attachment of the wires to the terminals.

It is accordingly an objective of the invention to provide an improved wiring fixture. A further objective is to provide a wiring fixture which can be used to connect wires to the terminals in a two-row electrical connector in either of two configurations. A further objective is to provide a wiring fixture which can be used to position the conductors in a ribbon cable in wire jugs. A still further objective is to provide a fixture of relatively simple construction which can be used by a technician without the necessity of a high degree of introductory training.

These and other objectives of the invention are achieved in a preferred embodiment thereof which is briefly described in the foregoing abstract, which is described in detail below, and which is shown in the accompanying drawings in which.

Figure 3:
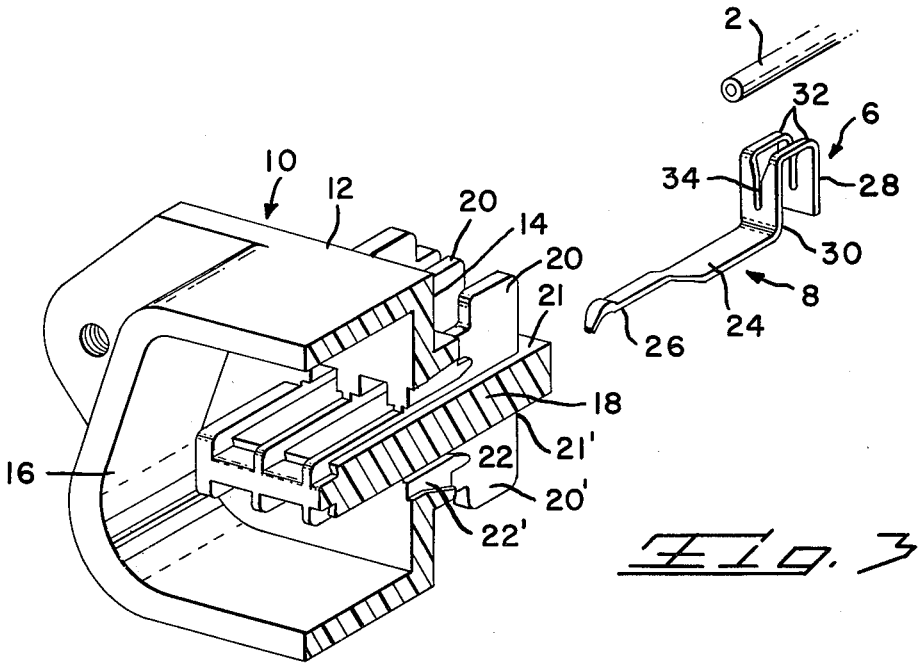
FIG. 3 is a sectional perspective view of a two-row electrical connector of a type to which wires are connected with the aid of a fixture in accordance with the invention.

A fixture in accordance with the invention serves to facilitate the insertion of wires into the wire receiving portions of terminals contained in a two-row electrical connector or similar electrical device. The disclosed embodiment of the invention is particularly intended to facilitate the insertion of wires into a connector of the type shown in FIG. 3 which is fully disclosed and claimed in U.S. Pat. No. 3,760,335. A brief description of the connector is presented below to provide background for the description of the present invention.

The connector 10 comprises a housing 12 having a rearward side 14 and a mating side 16. A ledge 18 extends centrally from the rearward side 14 and spaced-apart barriers 20, 20' are provided on the upper and lower surfaces 21, 21' of this ledge. An electrical contact terminal 8 is located between each pair of adjacent barriers and has a shank portion 24 which extends through a cavity 22 in the housing. It will thus be apparent that the terminals are arranged in two parallel rows. Each terminal has a contact section 26 at its forward end which is adapted to engage a complementary contact terminal in a complementary electrical connector.

Figure 4:
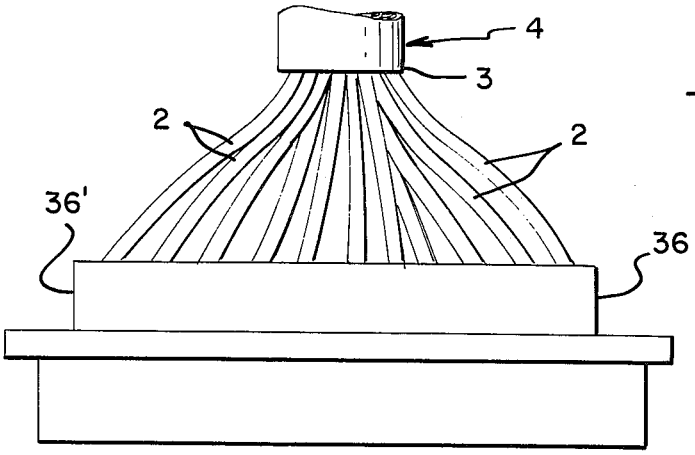
FIG. 4 is a plan view of the connector of FIG. 3 illustrating one wiring configuration.

The conductor-receiving portion 6 at the rearward end of each terminal comprises spaced apart parallel plate sections 28, 30, which are connected to each other at their upper ends by means of parallel connecting straps 32. Wire-receiving slots 34 extend downwardly into each plate section so that an individual wire 2 can be connected to the terminal upon movment of the wire laterally of its axis between the connecting straps 32, and into the slots 34. When a plurality of wires in a cable 4 are to be connected to the terminals in the connector 10, it is usually required that predetermined wires be connected to predetermined terminals. For example, it is common practice in the telephone industry to employ cables 4 which contain a plurality of twisted pairs of wires and when these wires are connected to these terminals in the connector, the wires of each pair are connected to corresponding terminals on the upper and lower sides 21, 21' of the ledge 18. The wires 2 of the cable 4 can be connected to the connection in either of the modes or configurations shown in FIGS. 4 and 5. In FIG. 4, the cable extends axially towards the rearward side of the connector and the wires fan out towards the terminals. It will thus be apparent that the wires which extend to the terminals which are adjacent to the ends 36, 36' of the connector must be longer than the wires which extend to the centrally located terminals.

Figure 5:
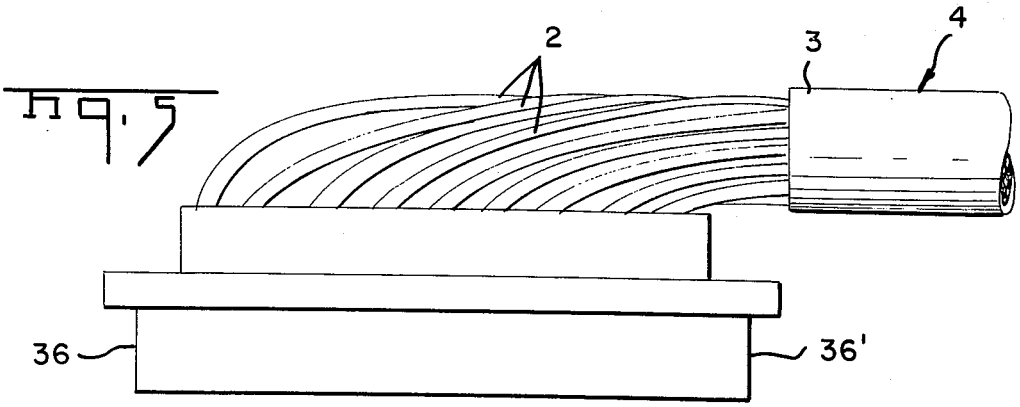
FIG. 5 shows an alternative wiring configuration for the connector of FIG. 3.

In FIG. 5, the cable 4 extends parallel to the rearward side of the connector and the wires extend laterally to the terminals in the connector. It will be apparent that the wires must be of increasing length from the end 36' of the connector to the other end 36.

Figure 1:
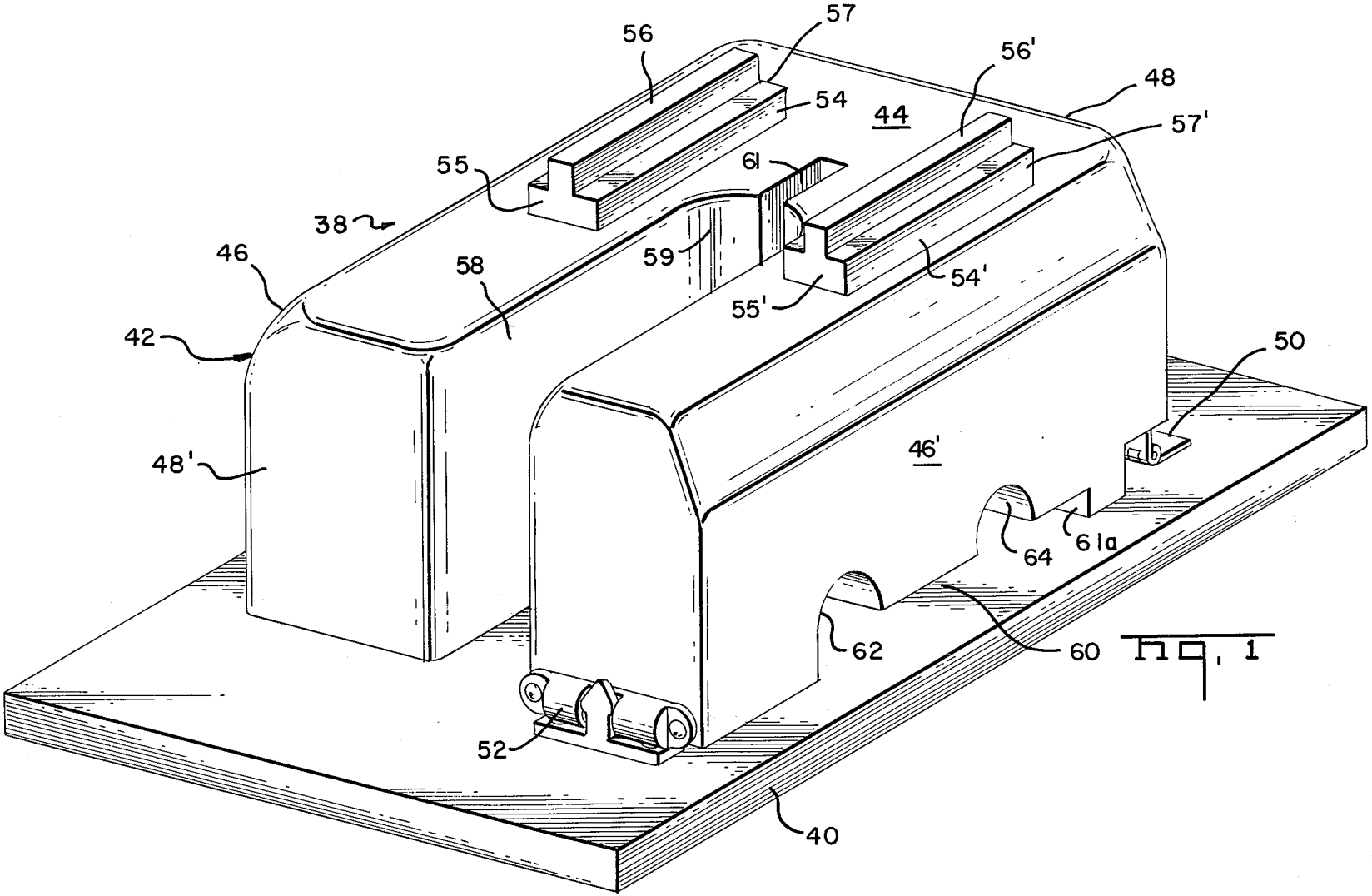
FIG. 1 is a perspective view of a preferred form of fixture in accordance with the invention.

Referring now to FIG. 1, a fixture 38 in accordance with the invention comprises a base plate 40 having a fixture block 42 on its upper surface. The plate and block may be of any suitable material, wood, metal, or plastic. The fixture block is generally rectangular having parallel sides 46, 46', an upper surface 44, and ends 48, 48'. One end 48 is connected to the plate 40 by a suitable hinge 50 so that the block can be swung upwardly from the position shown. A suitable detent latch 52 is provided at the other end 48' to hold the block in the position shown during placement of the wires in the wires jigs.

Positioning bosses 54, 54' are provided on the upper surface 44 of block 42, these bosses being in parallel, spaced apart and aligned relationship to each other. Each boss 54, 54' has ends 55, 57 and an upper surface on which there is provided a rib 56. As will be explained below, the bosses are dimensioned and shaped to support the wire jigs in predetermined positions.

A cable-receiving slot 58 extends inwardly in the block from the end 48' thereof, the semi-cylindrical inner end 59 of this slot being located midway between the ends 55, 55' and 57, 57' of the locating bosses 54, 54'. The width of the slot is sufficient to receive the cable 4 without an excessive amount of clearance as shown in the FIG. 6 and 8.

A narrow slot 61 extends inwardly from the semi-cylindrical inner end 54 of the cable-receiving slot 58. This narrow slot is provided for the accommodation of a flat conductor cable as will be described below.

Openings 62, 64 extend through the side 46 of the block at the lower surface of the block. These openings communicate with the slot 58 and are located at different distances from the end 48'. The opening 64 is located at approximately the inner end 59 of the slot 58 while the opening 62 is located between the plane defined by the ends 55, 55' of the positioning bosses and the end 48' of the fixture block. The significance of the locations of these openings will be described and discussed below.

It should also be noted that the downwardly facing surface of the fixture block 42 is cut away as shown at 60 to provide a shoulder 61*a* which faces the end 48' and a slight clearance to the right (as viewed in FIG. 1) of the shoulder. This clearance is provided to permit the use of ribbon cable in the fixture, as will also be described below.

Figure 2:
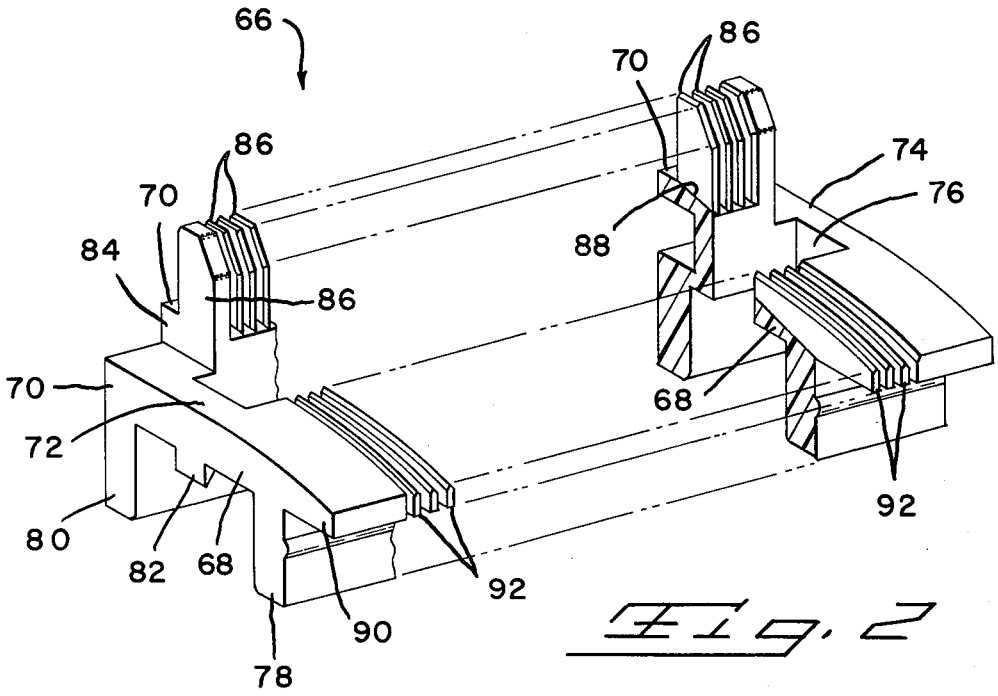
FIG. 2 is a perspective view of a wire locating jig which is used with the fixture of FIG. 1.

The wire jigs 66, 66' which are positioned on the locating bosses 54, 54' are substantially identical so that a description of one will suffice for both. Referring to FIG. 2, each jig 66 is in the form of a generally rectangular frame having parallel side rails 68, 70 and parallel end rails 72, 74. The ends and sides define a central rectangular opening 76. Flanges 78, 80 depend from the side rails 68, 70 respectively and the distance between the opposed surfaces of these flanges is substantially equal to the width of the boss 54. Additionally, ears 82 extend downwardly from the end rails 72, 74 and are spaced apart by a distance equal to the length of the boss. The jig members can thus be positioned on the bosses and will be precisely located by virtue of the flanges 78, 80 and the ears 82.

An elevated rib 84 is provided on the upper surface of the side rail 70 and a plurality of spaced apart fins or barriers 86 extend upwardly from this rib to define locating recesses for the wires. The space between adjacent barriers 88 is sufficient to receive one of the wires 2 and the surfaces between the barriers slop downwardly as viewed in the drawing towards the opening 76 as shown.

A lip 90 extends outwardly from the side rail 70 and spaced apart recesses are provided in the side rail and in the lip to define additional locating recesses for the wires. The locating recesses on the side rail 70 are in alignment with the locating recesses side 68 so that an individual wire can be positioned in two aligned recesses and it will extend over the central opening 76 of the jig.

Figure 6:
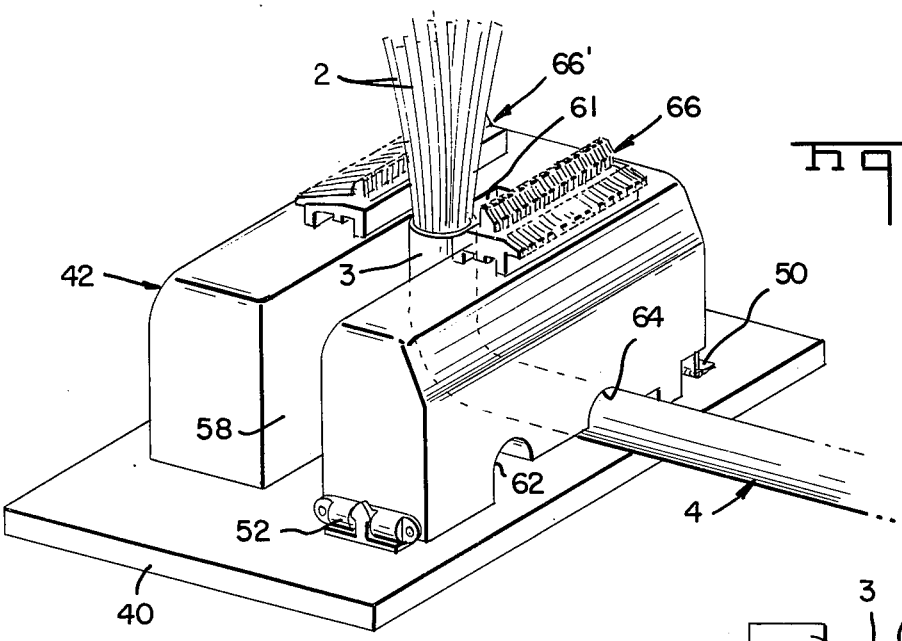
FIG. 6 is a view of the wiring fixture showing the position in which a cable occupies in the fixture when it is desired to produce the wiring configuration of FIG. 4.
Figure 7:
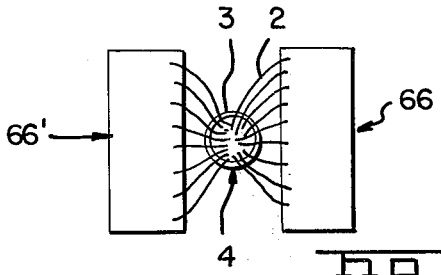
FIG. 7 is a perspective view of the cable having its wires positioned in the wire jigs, this view showing the positions of the parts for producing the connector wiring configuration of FIG. 4.

In use, and assuming that it is desired to connect the wires 2 to the connector in the manner shown in FIG. 4, the sheath 3 of the cable is stripped away to expose the end portions of the wires 2. The fixture block is then swung upwardly and the cable is positioned in the opening 64 with its end portion extending through the slot 58 and normally of the surfaces 44 of the block as shown in FIG. 6. It will be noted that the end of the cable sheath 3 is located at an elevation above the base plate such that the end of the sheath is substantially in the plane defined by the upper surfaces of the ribs 56, 56'. The wires 2 extend upwardly from the end of the cable sheath and can be bent laterally towards the wire jigs and placed in the recesses in the jigs. The wire jigs are then positioned on the bosses 54 in back-to-back relationship with the side rails 70 proximate to the slot 58. Wires are then selected from the upwardly extending wire bundle and selectively positioned in the wire jigs. Ordinarily, a twisted pair of wires will be selected from the bundle and one wire of the pair will be positioned in each of the wire jigs in corresponding recesses. After all of the wires have been positioned in the wire jigs, the jigs are lifted from the fixture block and the cable is removed from the block. At this stage, the wires will be located in the jigs as shown in FIG. 7, with the axis of the cable located midway between the end rails 72, 74 of the jigs. Thereafter, the cable and the wire jigs are mounted on a suitable wire trimming and inserting tool which, when operated, removes the wires from the wire jigs, trims the ends of the wires, and inserts the wires into the terminals of a connector. The wire insertion tool may be of the pivoted arm type shown in U.S. Pat. No. 3,800,390 or it may be of the straight action type shown in U.S. Pat. No. 3,816,897.

Figure 8:
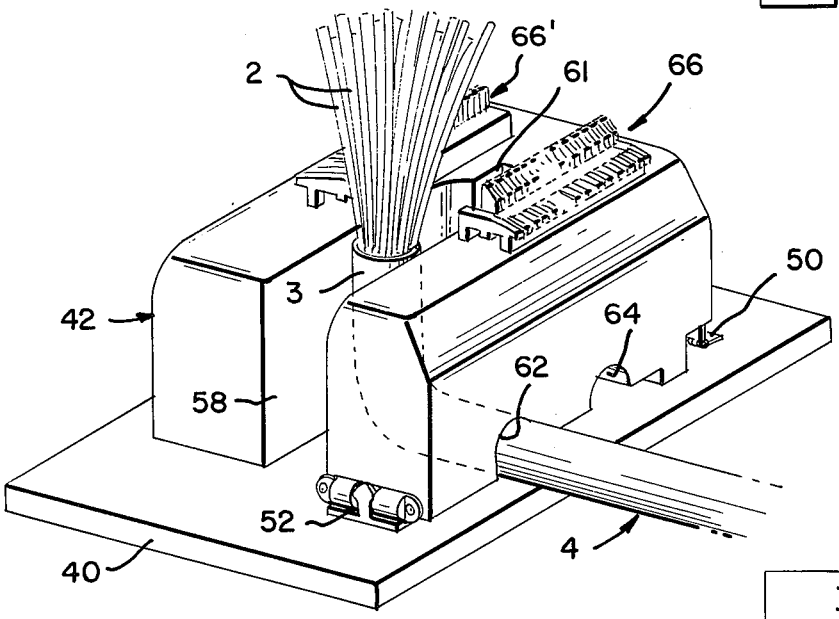
FIG. 8 is a view similar to FIG. 6 but showing the location in which the cable is positioned when it is desired to produce the wiring configuration of FIG. 5.
Figure 9:
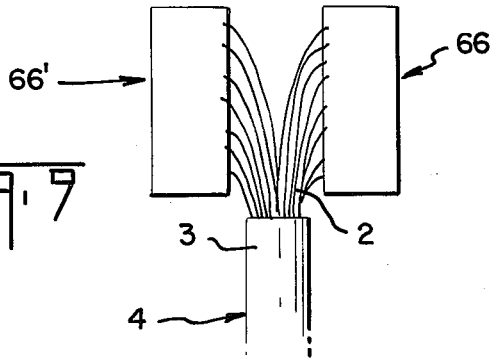
FIG. 9 is a view similar to FIG. 7 illustrating the positions of the cable and jigs required to produce the wiring configuration of FIG. 5.

If it is desired to connect the wires to the connector as shown in FIG. 5, the steps described above are followed except that the cable is positioned in the opening 62 of the fixture block so that its axis will extend upwardly as shown in FIG. 8, that is adjacent to, but spaced from, the ends 55 of the positioning bosses 54. When the wires are positioned in the wire jigs, there will be increasing wire lengths from one end of each jig to the other end. When the jigs are removed from the fixture, the appearance of the cable and the jigs will be as shown in FIG. 9 and when the jigs are subsequently placed on the insertion tool and the wires inserted into the terminals, the wiring configuration of FIG. 5 will result.

Figure 10:
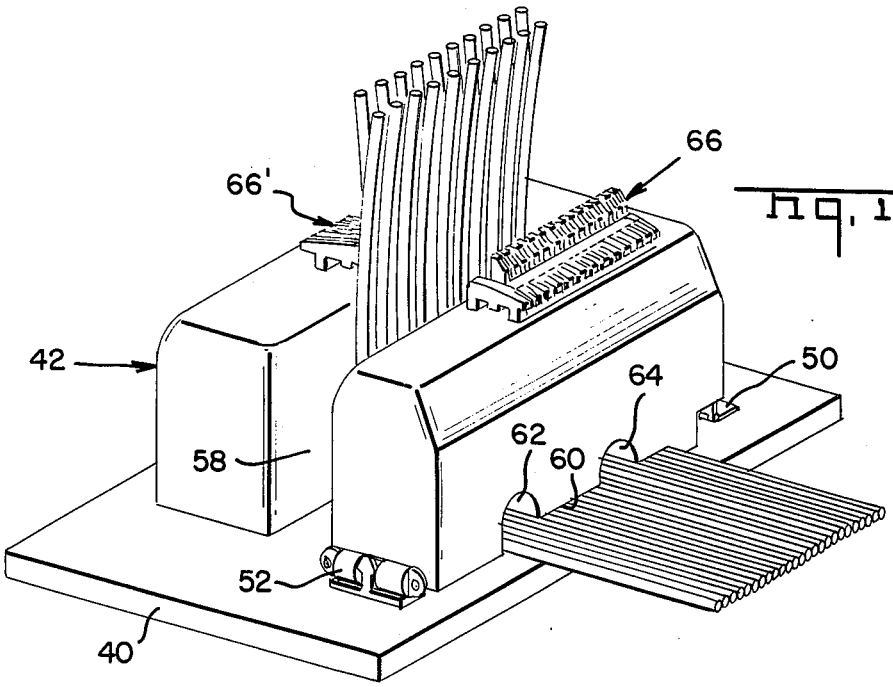
FIG. 10 is a view illustrating the manner of positioning a ribbon cable in the fixture preparatory to positioning the wires of the cable in the wiring jigs.

It will be apparent from the foregoing that a wiring jig in accordance with the invention provides a degree of versatility not previously available by virtue of the fact that either of the wiring configurations shown in FIGS. 4 and 5 can be produced. In addition, a fixture in accordance with the invention can be used with ribbon cable as shown in FIG. 10. Ribbon cable comprises a number of conductors in side-by-side relationship in a single plane. When it is desired to connect the conductors in a ribbon cable to the terminal connector of the type shown in FIG. 3, the ribbon cable is positioned between the fixture block 42 and the base plate 40 with the end portion of the ribbon cable extending upwardly through the slot 58 and through the narrow the narrow slot 61 such that one side edge of the cable is against the inner end of slot 61 and the central axis of the cable is located substantially at the inner end of the slot 58. The individual conductors of the ribbon cable are then dressed laterally towards the jigs 66 and positioned in the wire receiving recesses of the jigs. The fanning effect of FIG. 4 which is required for a cable of circular cross section is not required for a ribbon cable since the conductors extend directly to the terminals. The wiring configuration of FIG. 5 is not usually used when the conductors are in a ribbon cable but it can be achieved if the cable is clamped adjacent to the end 48' of the fixture block, and the end of the cable positioned in the entrance portion of the slot 58.

As previously mentioned, the conductors or wires 2 in the cable 4 are usually present as associated pairs of wires. The two wires of a pair are healically twisted together and, as previously mentioned, one wire of a pair is connected to one terminal in one of the rows and the other wire is connected to the corresponding terminal in the other row. The individual pairs of wires in the cable are usually identified by a color coding system, and it is usually necessary to connect the wires of a specifically identified pair to terminals at predetermined positions in the connector. This can by done by locating the wires in predetermined positions in the wire jig 66 members It is frequently convenient to place color coding indicia on the fixture to indicate to the technician the precise recesses in which the wires of a specific pair must be located. The indicia may comprise decals or the like as explained in U.S. Pat. No. 3,872,567 and the decals placed on the surface 44 beside the positioning bosses 54.

What is claimed is:

1. A fixture for facilitating the placement of wires in first and second wire holding jigs, each of said jigs having wire locating and holding means thereon for holding said wires in side-by-side parallel relationship, said fixture comprising:

a fixture block having a jig supporting surface.

a wire-receiving slot in said fixture block, said slot intersecting said surface, said slot having an inner end, first and second jig locating means on said surface for locating said first and second wire jigs thereon, said locating means being effective to locate said jigs on each side of said slot in parallel aligned relationship in orientations with said wire locating means extending transversely with respect to said slot, said inner end of said slot being substantially midway between the ends of jigs positioned on said jig locating means, and first and second wire bundle positioning means for selectively positioning a bundle of wires in said slot in either of first and second positions with the axis of said bundle extending normally of said surface, said first bundle positioning means being effective to position a bundle of wires at said inner end of said slot, said second bundle positioning means being effective to position a bundle of wires in said slot at a location which is adjacent to, and spaced from, the ends of wire jigs positioned on said jig locating means whereby, upon locating said jigs on said jig locating means, positioning a bundle of wires in said slot at said first bundle positioning means, and then positioning said wires in said wire locating and holding means of said jigs, said wires will be properly positioned for subsequent attachment to a connector in one configuration, and upon positioning a bundle of wires in said slot at said second bundle positioning means and then positioning said wires in said wire locating and holding means of second jigs, said wires will be properly positioned for subsequent attachment to a connector in a second configuration.

2. A fixture as set forth in claim 1, said fixture being intended for use with a multi-conductor cable having a circular cross section, said slot having a width which is at least sufficient to receive said cable.

3. A fixture as set forth in claim 2, said fixture having an additional slot extending centrally from said inner end of said slot, said additional slot being substantially narrower than said slot, said additional slot being dimensioned to receive a flat cable whereby said fixture can be used with flat cable.

4. A fixture as set forth in claim 3, said fixture block having an undersurface which oppositely directed with respect to said jig supporting surface, said first and second bundle positioning means comprising recesses extending across said undersurface and communicating with said wire receiving slot whereby said cable having a circular cross section can be selectively positioned in one of said recesses and said fixture block placed on a base plate surface to hold said cable in said first and second positions.

5. A fixture for facilitating the placement of wires in first and second wire holding jigs, each of said jigs having wire locating and holding means thereon for holding said wires in side-by-side parallel relationship, said fixture comprising:

fixture block means having a jig supporting surface, a wire-receiving slot extending into said fixture block means from one side edge thereof, said slot intersecting said surface, said slot having an inner end, first and second jig locating means on said surface for locating said first and second wire jigs thereon, said locating means being effective to locate said jigs on each side of said slot in parallel aligned relationship in orientations with said wire locating means extending transversely with respect to said slot, said inner end of said slot being substantially midway between the ends of jigs positioned on said jig locating means, first and second wire bundle positioning means for selectively positioning a bundle of wires in said slot in either of first and second positions with the axis of said bundle extending normally of said surface, said first bundle positioning means being effective to position a bundle of wires at substantially inner end of said slot, said second bundle positioning means effective to position a bundle of wires in said slot at a location between said one side edge of said body member and the ends of jigs positioned on said jig locating means which are proximate to said one side edge whereby, upon locating said jigs on said jig locating means, positioning a bundle of wires in said slot at said first bundle positioning means, and then positioning said wires in said wire locating and holding means of said jigs, said wires will be properly positioned for subsequent attachment to a connector in one configuration, and upon positioning a bundle of wires in said slot at said second bundle positioning means and then positioning said wires in said wires locating and holding means of second jigs, said wires will be properly positioned for subsequent attachment to a connector in a second configuration.

6. A fixture as set forth in claim 5, said fixture being intended for use with a multi-conductor cable having a circular cross section, said slot having a width which is at least sufficient to receive said cable.

7. A fixture as set forth in claim 6, said fixture having an additional slot extending centrally from said inner end of said slot, said additional slot being substantially narrower than said slot, said additional slot being dimensioned to receive a flat cable whereby said fixture can be used with flat cable.

8. A fixture as set forth in claim 7, said fixture block means having an undersurface which oppositely directed with respect to said jig supporting surface, said first and second bundle positioning means comprising recesses extending across said undersurface and communicating with said wire receiving slot whereby said cable having a circular cross section can be selectively positioned in one of said recesses and said fixture block placed on a base plate surface to hold said cable in said first and second positions.

* * * * *